United States Patent [19]

Touzani

[11] Patent Number: 4,955,493

[45] Date of Patent: Sep. 11, 1990

[54] COLLAPSIBLE EXPANSIBLE PLASTIC HOLLOW ARTICLES IN A LATCHABLE CONFIGURATION

[76] Inventor: William N. Touzani, Wilhelmanistraat 11, 2595 Em Den Haag, Netherlands

[21] Appl. No.: 394,352

[22] Filed: Aug. 15, 1989

[51] Int. Cl.[5] ..... B65D 23/00

[52] U.S. Cl. ..... 215/100 R; 215/1 C; 220/69; 220/85 H; 248/154

[58] Field of Search ..... 215/1 C, 12.1, 100 R, 215/228; 220/1 R, 69, 85 H, 212; 248/148, 154, 205.9, 206.2, 311.2

[56] References Cited

U.S. PATENT DOCUMENTS

| | | | |
|---|---|---|---|
| 648,436 | 5/1900 | Rider | 220/69 |
| 2,905,351 | 9/1959 | Lerner | 220/69 |
| 2,908,473 | 10/1959 | Snyder | 215/100 R |
| 4,001,444 | 1/1977 | Clarke | 248/154 |
| 4,492,313 | 1/1985 | Touzani | 215/1 C |
| 4,572,412 | 2/1986 | Brach et al. | 215/1 C |
| 4,574,969 | 3/1986 | Mays | 220/69 |
| 4,756,497 | 7/1988 | Lan | 248/311.2 |
| 4,773,458 | 9/1988 | Touzani | 220/1 R |

*Primary Examiner*—Jimmy G. Foster
*Attorney, Agent, or Firm*—Ladas & Parry

[57] ABSTRACT

A collapsible plastic hollow article having a top and a base joined by a substantially cylindrical side wall integral therewith and an aperture in the top, comprising a plurality of substantially circular bellows formed by conical sections integrally joined to create at least a portion of the side wall, the conical sections comprising alternating short portions and long portions, said short portions being at a greater angle to the bottle axis than said long portions, and the lesser diameter junctures of the long portions with the short portions being formed to create fold rings for the substantially circular bellows, wherein means for connecting a suction cup to said base.

17 Claims, 1 Drawing Sheet

COLLAPSIBLE EXPANSIBLE PLASTIC HOLLOW ARTICLES IN A LATCHABLE CONFIGURATION

BACKGROUND OF THE INVENTION

The field of the invention pertains to collapsible, expansible plastic hollow articles formed with a plurality of latchable side wall bellows to permit collapse of said articles and subsequent expansion thereof or vice versa.

Examples of a similar hollow article are disclosed in Diebolt et al U.S. Pat. No. 3,929,165 and in French Patent No. 2,467,146. Typically at least one bellow when pressed, overcenters and thus latches itself. To unlatch it, it will be necessary to pull the collapsed bellow or bellows apart. In order to do so, it is convenient to hold the hollow article in both hands.

SUMMARY OF THE INVENTION

According to the invention a collapsible plastic hollow article having a top and a base joined by a substantially cylindrical side wall integral therewith and an aperture in the top, comprising a plurality of circular bellows formed by conical sections integrally joined to create at least a portion of the side wall, the conical sections comprising alternating short portions and long portions, said short portions being at a greater angle to the axis of the hollow article than said long portions, and the lesser diameter junctures of the long portions with the short portions being formed to create fold rings for the substantially circular bellows, is characterized by means for connecting a suction cup to said base.

Thus it will be possible to attach the hollow article to a smooth, flat face of a heavy object and use both hands at one end of the hollow article to expand same.

A container for household use is contemplated as a preferred embodiment of the hollow article. The invention indeed provides the possibility to handle a container with one hand. In particular this proves to be advantageous if the container holds a liquid which otherwise, using two hands, might easily be spilled when unlatching the container.

A further advantage of the use of a suction cup is that the container will not easily tip over as a result of an inherent lack of stability of its bellow side walls.

The invention also enables the configuration of a latchable and expansible hollow article having an outside diameter of a size that excludes the possibility of appropriate accommodation of a hand grip.

In order to implement the connecting means of the invention, these means may comprise a collapsible hollow article wherein said connecting means comprise a substantially straight and circular cylinder side wall portion including said base and a separate counterpart means including said suction cup. Said straight side wall portion and said separate counterpart means including the suction cup may both comprise a thread means so that actually the counterpart means can be screwed over the straight side wall portion. The lower bellow thus is received into the counterpart means. This may be put to advantage by having the counterpart means adapted for sealingly adjoining the lower bellow.

The suction cup thus connected to the hollow article may comprise a central venting hole for communication between the space above the suction cup and the space below the suction cup. Both spaces are sealed if the connecting means is screwed against the lower bellow, the base itself is tight, and the suction cup is flattened against the smooth, flat face. Unscrewing the connecting means may then loosen the hold of the suction cup on the smooth, flat face. This device is a preferred embodiment for repetitive use of the suction cup.

A further preferred embodiment is connected with the use of ring-shaped suction cups. The connecting means for the hollow article of the invention comprise a substantially circular, collapsible hollow article wherein said connecting means comprise a substantially circular, substantially dish-shaped device in conformity therewith, including a coaxial, substantially circular cylindrical bottom support portion and a ring-shaped suction cup, the inner ring thereof being adapted to close around said substantially circular cylinder support portion, its dish-shape being arranged to receive the base of the hollow article.

Particularly when using wide diameter hollow articles this further preferred embodiment can be put to advantage. Use of the hollow article as a collapsible lamp stand is contemplated.

It is to be understood that the term "substantially circular" comprises oval and polygonal configurations. Also the term "substantially cylindrical" will include conical-shaped and barrel-shaped hollow articles.

DESCRIPTION OF THE PREFERRED EMBODIMENTS

Figure 1:
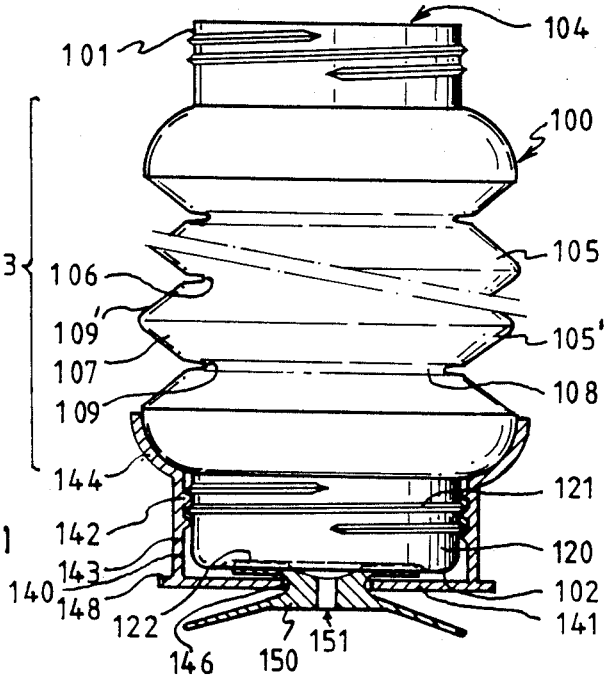
FIG. 1 is a partial cross-sectional view of a preferred embodiment of the invention.

In FIG. 1 a collapsible hollow article 100 comprises a top 101 having an aperture 104, a base 102, a cylindrical side wall 103 integral with said top and base and comprising a plurality of circular bellows 105, 105' each being formed by conical sections 106, 107 and joined to adjacent bellows at an inner fold ring 109, 109' providing a lesser diameter juncture 108.

At the base end of the hollow article 100 a circular, cylindrical straight side wall portion 120 comprises a thread means 121. Its base 102 includes a recessed wall portion 122 for receiving the upper face of a diabolo type suction cup 150.

A counterpart means 140 comprises a flat bottom part 141 including an aperture 146 for accommodating suction cup 150. A connecting means 140 is shaped like a cap, its flat bottom part extending into a flange 148 for a convenient grip. Its side wall is partly a straight, circular cylinder 143, wherein an inner thread means 142 extends into a cup-shaped part 144 that embraces the lower bellow and thus enables an air tight seal between counterpart means 140 and hollow article 100. An aperture 151 in suction cup 150 enables communication between the voids above the suction cup and below same.

Figure 2:
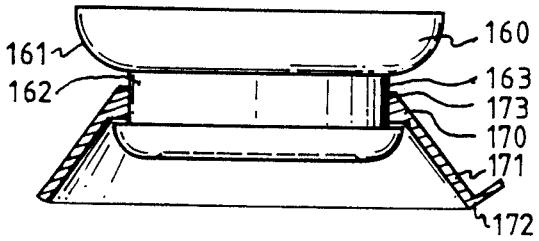
FIG. 2 is a partial cross-sectional view of a connecting means of the invention.

In FIG. 2 a counterpart means 160 is adapted for connecting a ring-shaped suction cup 170 to a hollow article. It does not require a circular, cylindrical straight side wall portion of the hollow article. This counterpart means 160 may be glued to the lower bellow or to the base of the hollow article in order to provide a suitable, relatively hard, cylindrical and smooth inner face 163 for joining the ring-shaped suction cup 170. The suction cup 170 comprises an apron 171 depending from a body comprising a smooth, substantially circular inner peripherical cylindrical face 173. A tab 172 is attached to enable lifting of the apron.

Figure 3:
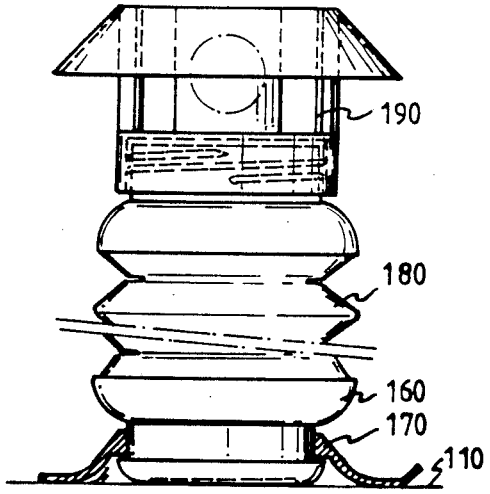
FIG. 3 is a partial cross-sectional view of another preferred embodiment of the invention, including the connecting means of FIG. 2 in its activated position.

In FIG. 3 counterpart means 160, 170 is put to use for holding a hollow article 180 at a level face 110. Container 180 carries an electrical lamp 190 the position of which can be varied by collapsing or expanding the hollow article.

I claim:

1. A collapsible and expandable plastic hollow article comprising: a top (101) and a base (102) joined by a substantially cylindrical side wall (103) having an axis and being integral with said top and said base and an aperture (104) in the top (101), said side wall comprising a plurality of substantially circular bellows (105, 105') formed by conical sections (106, 107) integrally joined to create at least a portion of said side wall (103), the conical sections (106, 107) comprising alternating short portions (107) and long portions (106), said short portions being at a greater angle to said axis than said long portions, said short portions joining with said long portions to form alternately junctures of greater and lesser diameters, the lesser diameter junctures (108) of the long portions (106) joining with the short portions (107) being formed to create fold rings (109, 109') for the substantially circular bellows; and connecting means for connecting a suction cup to said base, said connecting means being adapted for transferring an axially upwardly force exerted on said hollow article to said suction cup, so that in use the suction cup holds the base upon expansion of said hollow article.

2. A collapsible hollow article of claim 1, wherein said connecting means (140, 141, 142) comprise a substantially straight and circular, cylindrical side wall portion (120) including said base (102) and a separate counterpart means (140) including said suction cup.

3. A collapsible hollow article of claim 2, wherein said straight side wall portion (120) and said counterpart means (140) both comprise a thread means, an inner thread means (142) being included in said counterpart means (140) and an outer thread means (121) being included in said straight side wall portion (120), said inner and outer thread means being arranged for cooperation, and wherein said suction cup is in axial alignment with the inner thread means (121) of said counter part means.

4. A collapsible hollow article of claim 3, wherein said counterpart means (140) is adapted for sealing, by adjoining said cylindrical side wall (103).

5. A collapsible hollow article of claim 3, wherein said counterpart means is adapted for sealing, by adjoining a lower bellow of said cylindrical side wall.

6. A collapsible hollow article of claim 4, wherein said suction cup is arranged to have a central aperture, which opens into a space between said base and said counterpart means.

7. A collapsible hollow article of claim 5, wherein said suction cup is arranged to have a central aperture, which opens into a space between said base and said counterpart means.

8. A collapsible hollow article of claim 1, wherein said connecting means comprise a substantially circular, substantially dish-shaped device (160) including a coaxial, substantially circular, cylindrical bottom support portion (162) and a ring-shaped suction cup, the inner ring (173) thereof being adapted to close around said substantially circular, cylindrical support portion (162), its dish-shape being arranged to receive the base of the hollow article.

9. A collapsible hollow article of claim 8, wherein said substantially circular cylindrical bottom support portion (162) is a recess in said connecting means.

10. A device for use with a collapsible, expansible, plastic hollow article having a substantially cylindrical side comprising a plurality of substantially circular bellows, said hollow article having a base provided with a first connecting means, the device comprising a suction cup and being provided with a second connecting means being adapted for cooperation with said first connecting means for transferring an axially upwardly force exerted on said hollow article to said suction cup, so that in use the suction cup holds the base upon expansion of said hollow article.

11. A device as claimed in claim 10, wherein said second connecting means is formed as an inner thread means adapted for cooperation with said first connecting means formed as an outer thread means, wherein said suction cup is coaxial with said inner thread means.

12. A device as claimed in claim 11, wherein said device is adapted for sealing, by adjoining said cylindrical side of said hollow article.

13. A device as claimed in claim 12, wherein said suction cup comprises a central aperture, which opens into a space provided between said base of said hollow article and said device.

14. A device as claimed in claim 11, wherein said device is adapted for sealing by adjoining a lower bellow of said cylindrical side of said hollow article.

15. A device as claimed in claim 14, wherein said suction cup comprises a central aperture, which opens into a space provided between said base of said hollow article and said device.

16. A device as claimed in claim 10, wherein said second connecting means comprises a substantially circular, substantially dish-shaped device including a coaxial, substantially circular, cylindrical bottom support portion and a ring-shaped suction cup, the inner ring thereof being adapted to close around said substantially circular, cylindrical support portion, its dish-shaped being arranged to receive the base of the hollow article.

17. A device as claimed in claim 16, wherein said substantially circular cylindrical bottom support portion (162) is a recess in said second connecting means.

* * * * *